US005753604A

United States Patent [19]

Soldanski et al.

[11] Patent Number: 5,753,604

[45] Date of Patent: May 19, 1998

[54] WATER-CONTAINING FLOOR CLEANING COMPOSITION

[75] Inventors: Heinz-Dieter Soldanski, Essen; Daniela Poethkow, Duesseldorf, both of Germany

[73] Assignee: Henkel Kommanditgesellschaft auf Aktien, Duesseldorf, Germany

[21] Appl. No.: 628,708

[22] PCT Filed: Oct. 5, 1994

[86] PCT No.: PCT/EP94/03292

§ 371 Date: Apr. 15, 1996

§ 102(e) Date: Apr. 15, 1996

[87] PCT Pub. No.: WO95/10589

PCT Pub. Date: Apr. 20, 1995

[30] Foreign Application Priority Data

Oct. 14, 1993 [DE] Germany ..... 43 35 046.1

[51] Int. Cl.[6] ..... C11D 1/14; C11D 3/28

[52] U.S. Cl. ..... 510/214; 510/215; 510/216; 510/217; 510/475; 510/476

[58] Field of Search ..... 510/214–217, 510/475, 476

[56] References Cited

U.S. PATENT DOCUMENTS

| | | | |
|---|---|---|---|
| 3,234,158 | 2/1966 | Pfluger | 260/28.5 |
| 3,574,124 | 4/1971 | Lyness et al. | 252/153 |
| 3,728,418 | 4/1973 | Gleason | 260/898 |
| 4,017,662 | 4/1977 | Gehman et al. | 428/443 |
| 4,299,749 | 11/1981 | McCarthy et al. | 260/29.6 |
| 4,725,319 | 2/1988 | Osberghaus | 134/4 |
| 4,869,934 | 9/1989 | Jethwa | 427/393.5 |
| 5,409,639 | 4/1995 | Fusiak et al. | 510/214 |

FOREIGN PATENT DOCUMENTS

| | | |
|---|---|---|
| 215451 | 9/1986 | European Pat. Off. . |
| 362671 | 10/1988 | European Pat. Off. . |
| 2091255 | 1/1972 | France . |
| 2294231 | 7/1976 | France . |
| 3533531 | 9/1985 | Germany . |
| 4306899 | 3/1993 | Germany . |
| 1528592 | 10/1978 | United Kingdom . |
| WO 9003977 | 4/1990 | WIPO . |

*Primary Examiner*—Michael Lusignan

*Attorney, Agent, or Firm*—Ernest G. Szoke; Wayne C. Jaeschke; Real J. Grandmaison

[57] ABSTRACT

A water-containing floor cleaning composition in the form of a dispersion containing a surfactant, plasticizer, a high molecular weight polymer having a molecular weight of between $5\times10^5$ and $2.5\times10^6$ which is water-insoluble at a pH of about 12, and a low molecular weight polymer having a molecular weight of up to about 100,000 which is water-soluble at a pH of about 9.

9 Claims, No Drawings

WATER-CONTAINING FLOOR CLEANING COMPOSITION

BACKGROUND OF THE INVENTION

1. Field of the Invention

The present invention relates to an aqueous composition which may be used in diluted form for the cleaning and care of hard surfaces, more particularly floors.

Many new processes and compositions for the cleaning and care of floors have been developed in recent years and decades, not least because of the development of new materials for floor coverings. In practice, the choice of the composition is largely determined by whether the surface is to be primarily cleaned or primarily preserved. Thus, compositions which produce more or less hard and resistant films are mainly used for the care and preservation of surfaces. To this end, the compositions contain—generally in emulsified form—waxes or film—forming polymers and crosslinking agents, generally heavy metal salts, which together form self-shine or polishable films on the treated surfaces after drying. Long-lasting protection of the surfaces can be obtained in this way, severe mechanical stressing also being absorbed according to the quality of the film. However, the removal of such films, as necessitated for example by soiling or damage, is only possible under extreme conditions. By contrast, compositions which are mainly intended for cleaning have high surfactant contents, often together with alkaline substances, organic solvents or abrasives. In many cases, soil and old films can be thoroughly removed with such compositions although the surfaces thus cleaned are generally then exposed to resoiling without protection unless they are subsequently subjected to a preserving treatment.

2. Discussion of the Related Art

Since, in many cases, cleaning and care of the floor surface are desirable in equal measure, compositions with which cleaning and preservation are possible in a single operation have also been developed in addition to the compositions mentioned above. Examples of such compositions can be found, for example, in GB-PS 1,528,592, in German patent application 35 33 531 and in earlier hitherto unpublished German patent application P 43 06899. These compositions, which are also known as floor wiping compositions, contain sufficient quantities of surfactants, more particularly nonionic and anionic surfactants, in addition to alkali-soluble film-forming polymers so that the compositions may be used equally for care and cleaning. However, it is remarkable that, even when compositions of the type in question are repeatedly applied, no additional gloss is imparted to the floor. In many cases, however, high cleaning performance and a distinct buildup of gloss are required in particular for heavily stressed floors. At the same time, resoiling of the treated surfaces should remain minimal. Providing a composition which would combine all these properties was one of the problems addressed by the present invention.

DESCRIPTION OF THE INVENTION

The present invention relates to a water-containing floor cleaning composition in the form of a dispersion containing surfactant, film-forming polymer and plasticizer and optionally other typical constituents of floor wiping compositions, characterized in that it contains both a high molecular weight polymer, which is insoluble in water at a pH value of 12, and a low molecular weight polymer which is soluble in water at a pH value of 9.

The new composition has excellent cleaning power and provides the surface of the floor after drying with a very uniform distinct shine which increases in the event of repeated application. Nevertheless, the tendency of the floors thus cleaned towards resoiling is extremely slight. It is particularly remarkable that the glossy film is obtained without the use of heavy metal salts as a crosslinking component.

The new compositions are characterized by the simultaneous presence of two different polymers of which one has a high molecular weight and is insoluble, even in strong alkali, while the second polymer has a relatively low molecular weight and forms a clear solution in water even at a pH value of 9 or lower. Several chemically different types of one or the other polymer may of course also be present. Both the high molecular weight polymer and the low molecular weight polymer are homopolymers or, preferably, copolymers which consist at least partly of esters of acrylic acid or methacrylic acid. The high molecular weight polymer is preferably selected from the group of polyacrylates and acrylate/styrene copolymers and contains only small quantities, if any, of carboxyl groups. The low molecular weight polymers are preferably copolymers of acrylic acid or methacrylic acid with esters of acrylic acid, methacrylic acid or styrene. The molecular weight of the high molecular weight polymer is typically between about $5\times10^5$ and $2.5\times10^6$ and preferably between $1.0\times10^6$ and $2.0\times10^6$. The molecular weight of the low molecular weight polymer normally is not above about 100,000 and is preferably between 30,000 and 80,000. Polymers of both types are commercially available, mostly in the form of aqueous dispersions with a solids content of from about 30 to 50% by weight and a substantially neutral to mildly acidic pH value. Among the high molecular weight polymers, those which are insoluble in water, even at a pH value of 12, are suitable for the compositions according to the invention. To test this property, 5 parts by weight of the polymer or a correspondingly larger quantity of an aqueous dispersion thereof are made up to 100 parts by weight with distilled water and adjusted to pH 12.0 with 10% sodium hydroxide solution with stirring at room temperature. During this treatment, the polymer should not dissolve inside 10 minutes. By contrast, among the low molecular weight polymers, only those types which, in the form of a 5% dispersion in water, form a clear solution at room temperature within 10 minutes of the addition of aqueous ammonia to a pH value of 9.0 are suitable for the compositions according to the invention.

Examples of some commercial types of the high molecular weight polymer are the products Primal NT-2624, Primal NT-2819, Primal NT-2611 of Rohm & Haas, the products Neocryl AS 8-B and Neocryl AS 19 of Zeneca, the product Ubatol U 4138 of Stapol, the product Poligen ES 9666 of BASF and the product D 40-3 A of Morton International. The high molecular weight polymers should preferably have minimum film-forming temperatures of 40° to 80° C. Examples of suitable low molecular weight commercial products are the polymers Primal E 1531 of Rohm & Haas and Neocryl XK 39 of Zeneca. The total content of the above-mentioned polymers in the compositions according to the invention is preferably from 3 to 15% by weight and more preferably from 5 to 12% by weight. The ratio by weight of high molecular weight to low molecular weight polymer is preferably 1:4 to 4:1 and more preferably 1:1 to 3:1.

In addition to the combination of at least two polymers of different molecular weight, the compositions according to the invention contain at least one surfactant and one plasticizer. Their surfactant content is preferably from 1 to 6% by weight and more preferably from 1.5 to 3% by weight, based on the total weight of the composition. Their plasticizer content is preferably from 0.3 to 5% by weight and more preferably from 0.6 to 3% by weight, again based on the total weight of the composition.

The surfactants present are preferably nonionic or anionic surfactants. In principle, suitable nonionic surfactants for the compositions according to the invention are any types of nonionic surfactants providing they meet the low foaming requirement. Corresponding nonionic surfactants are, above all, the adducts of 3 to 20 moles of ethylene oxide (EO) with primary $C_{8-20}$ alcohols, for example with cocofatty alcohol or tallow fatty alcohol, oleyl alcohol, oxoalcohols or secondary alcohols with the same chain length. Other suitable nonionic surfactants are the corresponding ethoxylation products of other long-chain compounds, for example fatty acids and fatty acid amides containing 12 to 18 carbon atoms and alkyl-phenols containing 8 to 16 carbon atoms in the alkyl moiety. In all these products, the ethylene oxide may be partly replaced by propylene oxide (PO). Other suitable nonionic surfactants are mono- and diethanolamides of fatty acids and long-chain amine oxides or sulfoxides, for example the compound N-cocoalkyl-N,N-dimethylamine oxide. Other nonionic surfactants which may be used in accordance with the invention are the water-soluble adducts—containing 20 to 250 ethylene glycol ether groups and 10 to 100 propylene glycol ether groups—of ethylene oxide with polypropylene glycol, alkylenediamine polypropylene glycol and with alkyl polypropylene glycol containing 1 to 10 carbon atoms in the alkyl chain, in which the polypropylene glycol chain performs a hydrophobic function. Of the nonionic surfactants mentioned above, the adducts of 3 to 10 moles of ethylene oxide with long-chain primary alcohols containing 10 to 16 carbon atoms from the group of oxoalcohols and particularly the natural fatty alcohols are preferably present in the compositions according to the invention.

A most particularly preferred class of nonionic surfactants for the compositions according to the invention are alkyl polyglycosides. Alkyl polyglycosides are surfactants corresponding to general formula I:

$$R—O(—G)_n \quad (I)$$

in which R is a long-chain alkyl radical containing 8 to 22 carbon atoms, G is a glycoside-bonded residue of a monosaccharide and n has a value of 1 to 10. Where these surfactants are used in the compositions according to the invention, extremely high cleaning power with only a very slight tendency towards resoiling are achieved even with small quantities of surfactant. In a preferred embodiment of the invention, therefore, alkyl polyglycosides make up the predominant component of the total surfactant content of the compositions according to the invention. In a particularly preferred, alkyl polyglycosides are exclusively used as surfactants in the compositions according to the invention.

Alkyl polyglycosides have been known as surface-active substances for more than 50 years and can be produced by various methods, cf. inter alia European patent application 362 671 in which literature on earlier processes is also cited. Alkyl glycosides in which (—G) is derived from glucose are preferably used for the purposes of the invention. The alkyl moiety R is preferably derived from long-chain, optionally unsaturated, preferably primary alcohols which may be branched, but are preferably not branched. Examples are the synthetic oxoalcohols containing 9 to 15 carbon atoms and the fatty alcohols containing 8 to 22 carbon atoms obtained from natural fatty acids. Alkyl polyglycosides of which the glycoside component consists of 1 to 2 glycose units and of which the alkyl component is derived from fatty alcohols containing 8 to 10 carbon atoms are preferably used for the purposes of the present invention.

The anionic surfactants present in the compositions according to the invention may be above all synthetic anionic surfactants, particularly those of the sulfonate and sulfate type.

Surfactants of the sulfonate type include alkyl benzene sulfonates with a $C_{9-15}$ alkyl radical and olefin sulfonates, i.e. mixtures of alkene and hydroxyalkane sulfonates, and also the disulfonates obtained, for example, from $C_{12-18}$ monoolefins with a terminal or internal double bond by sulfonation with gaseous sulfur trioxide and subsequent alkaline or acidic hydrolysis of the sulfonation products. Other suitable surfactants of the sulfonate type are the alkane sulfonates obtainable from $C_{12-18}$ alkanes by sulfochlorination or sulfoxidation and subsequent hydrolysis or neutralization or by addition of bisulfites onto olefins and also the esters of α-sulfofatty acids, for example the α-sulfonated methyl or ethyl esters of hydrogenated coconut oil, palm kernel oil or tallow fatty acids.

Suitable surfactants of the sulfate type are the sulfuric acid monoesters of long-chain primary alcohols or natural or synthetic origin, i.e. of fatty alcohols such as, for example, cocofatty alcohols, oleyl alcohol, lauryl alcohol, myristyl alcohol, palmityl alcohol or stearyl alcohol, or $C_{10-20}$ oxoalcohols or secondary alcohols with the same chain length. The sulfuric acid monoesters of aliphatic long-chain primary alcohols ethoxylated with 1 to 6 moles of ethylene oxide (EO) or ethoxylated secondary alcohols are also suitable. Sulfated fatty acid alkanolamides, sulfated fatty acid monoglycerides and long-chain sulfosuccinic acid esters are also suitable. The anionic surfactants are preferably used in the form of alkali metal salts, more particularly sodium salts, although ammonium salts or the salts of alkanolamines containing 2 to 6 carbon atoms may also be used. Particularly preferred anionic surfactants for the purposes of the invention are fatty alcohol sulfates and fatty alcohol ether sulfates, for example $C_{12}/C_{18}$ cocoalcohol sulfate Na and $C_{12/14}$ cocoalcohol+2 EO sulfate.

Anionic surfactants are preferably used in combination with nonionic surfactants. A particularly preferred combination consists of fatty alcohol sulfate and fatty alcohol ethoxylates containing 3 to 6 ethylene oxide units.

In addition to the nonionic and anionic surfactants mentioned, the compositions according to the invention may also contain relatively small quantities of other surfactants, more particularly amphoteric surfactants, and soaps if this is appropriate for obtaining special effects and does not affect the other favorable properties of the compositions. The soaps are the water-soluble salts of long-chain fatty acids preferably containing 12 to 18 carbon atoms, for example cocofatty acid sodium salt and tallow fatty acid sodium salt. The amphoteric surfactants are long-chain compounds of which the hydrophilic component consists of a cationically charged center (normally a tertiary amino group or a quaternary ammonium group) and an anionically charged center (normally a carboxylate group or a sulfonate group). Examples of such surfactants are N-cocoalkyl-N,N-dimethylaminoacetate and N-dodecyl-N,N-dimethyl-3-aminopropane sulfonate.

The plasticizers present in the compositions according to the invention may be both temporary plasticizers and permanent plasticizers. A mixture of both types is mostly used.

The function of the plasticizers on the one hand is to facilitate formation of the polymer film on drying of the cleaning composition and, at the same time, to prevent embrittlement of the film after drying. Temporary plasticizers are plasticizers which show significant volatility at room temperature so that they evaporate from the floor care films after a certain time whereas permanent plasticizers are non-volatile and remain in the films. Examples of suitable temporary plasticizers are ethers of monoethylene glycol, diethylene glycol and triethylene glycol and of dipropylene glycol and tripropylene glycol and also the acetates of these ethers providing they are sufficiently soluble in water and are acceptable from the odor standpoint. Examples of suitable permanent plasticizers are tributoxyethyl phosphate, mono- and dialkyl esters of phthalic acid, 2,2,4-trimethyl pentane-1,3-diol mono- and diisobutyrate and 2-methyl pyrrolidine.

In addition to the constituents mentioned above, the compositions according to the invention may contain other typical constituents of floor wiping compositions. The only requirement in this regard is of course that the positive properties of the compositions should not be adversely affected by their presence. The typical ingredients in question include, above all, waxes with which the floor-care properties of the compositions can be further modified. Suitable waxes are both waxes of natural origin and waxes of synthetic origin, for example carnauba wax and candelilla wax or polyethylene wax and montan ester wax. The montan ester waxes are those with dropping points of 75° to 90° C. and acid values of 15 to 40. The polyethylene waxes preferably have dropping points of 100° to 140° C. The waxes preferably make up no more than 5% by weight and, more particularly, from 0.1 to 2% by weight of the compositions according to the invention.

Examples of other typical additives include organic, completely water-miscible solvents which are used to enhance performance and optionally to improve wetting power. Lower alcohols containing 2 or 3 carbon atoms are preferably used, but in quantities of no more than 10% by weight and preferably in quantities of from about 0.2 to 5% by weight, based on the total weight of the undiluted composition. Examples of other additives are perfume oils, dyes, viscosity regulators, pH regulators and preservatives. These substances are typically used in quantities of not more than 5% by weight and preferably in quantities of 0.01 to 2% by weight.

The pH value of the compositions is preferably between 7 and 11 and more particularly between 8 and 10 although in individual cases values outside these ranges, for example in the mildly acidic range, may also be selected should this be appropriate for any particular reason. pH values in the alkaline range are adjusted by addition of typical alkalis, for example KOH, NaOH, $Na_2CO_3$, $NH_3$ and alkanolamines, preferably by addition of ammonia and/or NaOH.

The compositions are applied by initially preparing a formulation of the composition, in which the content of non-volatile components is between about 1 and about 4 g/l, by dilution with water. Depending on the concentration of the original composition, this concentration is achieved by dilution in a ratio of about 1:200 to about 1:15. The dilute formulation is then applied to the surface to be cleaned with an absorbent article, for example with a wiping cloth or a sponge, and then partly removed from the surface with the soil. After this treatment, the surface is not rinsed so that the remaining cleaning solution can dry to form a uniform protective film. It is due to this method of application that the compositions in question are also known as wiping compositions. The composition according to the invention is distinguished by an powerful cleaning effect on a number of soil types and, at the same time, forms a resistant film which affords excellent protection against resoiling. The film provides even heavily stressed floors with an additional shine which increases with repeated application of the composition. The composition is particularly suitable for the care and cleaning of floors and gives excellent results on stone floors, sealed parquet, tiles, linoleum and plastic floors. The floor-care properties of the composition are particularly noticeable on mat surfaces which receive an additional shine through application of the composition.

The preparation of the composition in its various forms does not involve any difficulties. Normally, the low molecular weight polymer is initially dissolved in water, optionally together with alkalizing agents, after which the surfactants are introduced in the required concentration before the high molecular weight polymer is added, normally in the form of a dispersion. Plasticizers and the other additives are generally added last.

EXAMPLES

Compositions 1 to 7 according to the invention and comparison compositions 8 to 14 as indicated in Table 1 were prepared by mixing the individual constituents in water. The pH value of all the compositions was adjusted with ammonia to 9.0. Figures against the ingredients in Table 1 represent percentages by weight, the balance to 100% by weight being water. Quantities of 25 g of these compositions were diluted with water to 1 liter and used in this form to test cleaning power, shine and resoiling behavior. The test results are also set out in Table 1.

The various tests were carried out as follows:

1. Testing of Cleaning Power

The cleaning effect of the wiping compositions was determined using a Gardner washability and scouring tester as described in the quality standards of the Industrieverband Putz- und Pflegemittel e.V. (Seifen-Öle-Fette-Wachse, 108, pages 526 to 528 (1982)). In this method, a white PVC film is coated with a test soil of soot and grease and machine-wiped under standardized conditions with a sponge soaked with the cleaning composition. Cleaning performance is measured by photoelectric determination of the degree of reflectance (in %).

2. Shine

The shine test was carried out on an anthracite-colored terrazzo tile with light inclusions which had a surface area of 15×30 cm. 3 ml of the test solution were applied to the tile and uniformly distributed with a cotton cloth which had been moistened and thoroughly wrung out. This treatment was carried out a total of 20 times, each time with a new cloth, the time interval between two applications being at least one hour so that the surface was able to dry off uniformly in each case. The shine was then measured with a Dr. Lange reflectometer (measuring angle 60°) and compared with the starting value of the untreated tile. The differences between the two measured values are shown in the Table as an increase in shine, the measured values being determined as average values from measurements at 6 different points. In the case of the compositions according to the invention, the measured values never differed by more than one unit from the average value.

3. Testing of Resoiling Behavior

For this test, a white PVC covering (75×21 cm) was divided into three equal sections of 25×21 cm. Quantities of 1.2 ml of the solution to be tested were applied to each of the surfaces using a cotton cloth. This wiping operation was repeated 9 times after drying. Resoiling behavior was then tested after drying in a special drum in which the PVC covering was placed and moved around for 30 minutes at 25 r.p.m. with 36 g of a special soiling mixture. The test soil had the following composition:

3 g of sieved vacuum cleaner dirt (RFC of the W äschereiforschung, Krefeld)

3 g of burnt sea sand 15 g of plastic granules (Durethan WKV 30, a product of Bayer AG, Leverkusen)

15 g steel balls 6–7 mm in diameter.

After the soiling treatment, the test covering was removed from the drum, tapped and visually evaluated by three people. Evaluation was based on the following scale:

1=covering very light, hardly soiled

2=covering light, moderately soiled

3=covering light grey, medium-soiled

4=covering grey, heavily soiled

5=covering dark grey, very heavily soiled.

It is clear from the test results set out in Table 1 that the compositions according to the invention show high cleaning power and also produce a distinct increase in shine for minimal resoiling.

TABLE 1

| | Examples | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Alkali-insoluble acrylate/styrene copolymer (Primal NT 2624), molecular weight above 500,000 | 4 | 3 | 4 | 8 | 6 | 3 | 8 | — | — | — | 6 | 9 | 9 | 12 |
| Alkali-soluble acrylate/styrene copolymer (Primal E 1531), molecular weight below 100,000 | 2 | 6 | 8 | 4 | 3 | 6 | 4 | 6 | 9 | 12 | — | — | — | — |
| $C_{8-10}$ Alkyl polyglucoside (1.6 glucose) | 2.1 | 2.1 | 2.1 | 2.1 | — | — | — | 2.1 | 2.1 | 2.1 | 2.1 | 2.1 | 7 | 2.1 |
| $C_{12-14}$ Fatty alcohol sulfate Na | — | — | — | — | 2 | 1 | 2 | — | — | — | — | — | — | — |
| $C_{12-14}$ Fatty alcohol + 4 EO | — | — | — | — | 1 | 1 | — | — | — | — | — | — | — | — |
| $C_{12-14}$ Fatty alcohol + 6 EO | — | — | — | — | — | — | 1 | — | — | — | — | — | — | — |
| Tributoxy ethyl phosphate | 0.75 | 0.75 | 0.75 | 0.75 | 0.75 | 0.75 | 0.75 | 0.75 | 0.75 | 0.75 | 0.75 | 0.75 | 0.75 | 0.75 |
| Diethylene glycol monomethyl ether | 1.5 | 1.5 | 1.5 | 1.5 | 1.5 | 1.5 | 1.5 | 1.5 | 1.5 | 1.5 | 1.5 | 1.5 | 1.5 | 1.5 |
| Perfume, preservative | + | + | + | + | + | + | + | + | + | + | + | + | + | + |
| 1. Cleaning power | 61 | 60 | 61 | 58 | 59 | 58 | 59 | 64 | 60 | 67 | 40 | 40 | 54 | 39 |
| 2. Increase in shine on terrazzo | +12 | +19 | +19 | +23 | +18 | +19 | +22 | +6 | +9 | +4 | +16 | +20 | ±0 | +25 |
| 3. Resoiling behavior | 2 | 2 | 2 | 2 | 2 | 2 | 2 | 2 | 2 | 2 | 2 | 2 | 5 | 2 |

What is claimed is:

1. A water-containing floor cleaning composition in the form of a dispersion, said composition comprising a surfactant, plasticizer, a high molecular weight copolymer having a molecular weight of between $5\times10^5$ and $2.5\times10^6$ which is water-insoluble at a pH of about 12, and a low molecular weight copolymer having a molecular weight of up to about 100,000 which is water-soluble at a pH of about 9.

2. A floor cleaning composition as in claim 1 wherein said low molecular weight copolymer has a molecular weight of from about 30,000 to 80,000.

3. A floor cleaning composition as in claim 1 wherein said high molecular weight copolymer is selected from the group consisting of polyacrylates, acrylate/styrene copolymers, and mixtures thereof.

4. A floor cleaning composition as in claim 1 wherein said high molecular weight copolymer has a minimum film forming temperature of 40° C. to 80° C.

5. A floor cleaning composition as in claim 1 wherein said low molecular weight copolymer is selected from the group consisting of copolymers of acrylic acid or methacrylic acid with esters of acrylic acid, methacrylic acid or styrene.

6. A floor cleaning composition as in claim 1 containing a total of 3% to 15% by weight of said copolymers, based on the weight of said composition, and wherein the ratio by weight of said high molecular weight copolymer to said low molecular weight copolymer is 1:4 to 4:1.

7. A floor cleaning composition as in claim 1 containing 0.3% to 5% by weight of said plasticizer.

8. A floor cleaning composition as in claim 1 containing 1% to 6% by weight of said surfactant.

9. A floor cleaning composition as in claim 1 wherein said surfactant comprises an alkyl polyglycoside.

* * * * *